United States Patent [19]

Hackmann et al.

[11] Patent Number: 4,991,748

[45] Date of Patent: Feb. 12, 1991

[54] DEVICE FOR DISPENSING PORTIONS OF GRAINY MEDIA, IN PARTICULAR PELLETS

[75] Inventors: Ludger Hackmann; Josef Wilken; Werner Sieverding, all of Lohne, Fed. Rep. of Germany

[73] Assignee: ByK Gulden Lomberg Chemische Fabrik GmbH, Konstanz, Fed. Rep. of Germany

[21] Appl. No.: 411,480

[22] PCT Filed: Mar. 12, 1988

[86] PCT No.: PCT/EP88/00197

§ 371 Date: Nov. 17, 1989

§ 102(e) Date: Nov. 17, 1989

[87] PCT Pub. No.: WO88/07483

PCT Pub. Date: Oct. 6, 1988

[30] Foreign Application Priority Data

Mar. 21, 1987 [DE] Fed. Rep. of Germany ..... 8704248

[51] Int. Cl.[5] ..... G01F 11/10

[52] U.S. Cl. ..... 222/361

[58] Field of Search ..... 222/359, 361, 362, 365, 222/367, 368, 370; 221/263, 265, 266

[56] References Cited

U.S. PATENT DOCUMENTS

| | | | |
|---|---|---|---|
| 11,980 | 11/1854 | Waterbury | 222/368 |
| 2,180,916 | 11/1939 | Stevernagel et al. | 222/361 X |
| 2,603,386 | 7/1952 | Barnes | 222/361 X |
| 2,679,950 | 6/1954 | Swanson | 221/266 |
| 2,857,083 | 10/1958 | Masterson | 222/362 X |
| 3,201,007 | 8/1965 | Transeav | 222/368 X |
| 3,353,723 | 11/1967 | Wieleba | 222/368 |
| 4,724,984 | 2/1988 | Wilken et al. | 222/361 |

FOREIGN PATENT DOCUMENTS

| | | | |
|---|---|---|---|
| 2209733 | 5/1989 | United Kingdom | 222/363 |

*Primary Examiner*—Kevin P. Shaver

*Attorney, Agent, or Firm*—Toren, McGeady & Associates

[57] ABSTRACT

A device for dispensing grainy media, in particular pellets, from a storage space in a housing. The housing has a dispensing opening near the bottom thereof and can be closed by a hand-operated actuator. The actuator has a dosing chamber the internal end of which is closed in the dispensing position of the actuator relative to the storage space by a partition wall and whose dispensing end is aligned with the dispensing opening in the dispensing position. The size of the dosing chamber is substantially greater than the diameter of the pellets. The dosing chamber has a cover which adjacent the storage area forms an auxiliary dosing chamber. The auxiliary dosing chamber has a depth which is approximately equal to the diameter of a pellet and has upper flanks which converge toward one another and end in an upwarded direction notch, wherein the notch is narrower than the diameter of a pellet.

7 Claims, 6 Drawing Sheets

DEVICE FOR DISPENSING PORTIONS OF GRAINY MEDIA, IN PARTICULAR PELLETS

Figure 2:
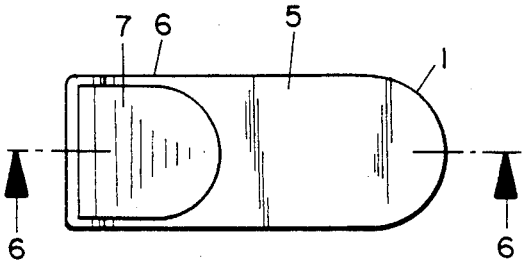

The invention is a device for dispensing portions of grainy media, in particular pellects, from the storage space in a housing, having a dispensing opening near the bottom of the housing, which can be closed by means of a hand-operated actuator. The actuator has a dosing chamber, the internal end of which is partitioned off (partition wall) from the storage chamber in the dispensing position. In the dispensing position, the external end of the dosing chamber is aligned with the dispensing opening, whereby the size of the dosing chamber, which has a sloping roof inclined in the dispsnsing direction, is much greater than the diameter of the pellets.

A device of this nature is the subject of the applicant's German patent application No. P35 35 292.2. In the case of smaller pellets, there is a danger that they will become jammed in the area between the storage chamber and the dosing chamber, partly as a result of the amount of clearance and partly because the media being dispensed are not always exactly spherical. In the worst case, this can result not only in the mechanism becoming jammed, but even in one or more of the pellets being crushed.

The purpose of the invention is to develop a device of the type described, without adding any additional components, in such a way that it is simple to construct and so that the smallest quantities can be dispensed, easily, exactly and free from interference.

In accordance with the present invention, a portion of the cover adjacent the storage space defines an auxiliary dosing chamber. The auxiliary dosing chamber has a depth which corresponds approximately to the diameter of a pellet. In addition, the portion of the cover defining the auxiliary dosing chamber has upper flanks which converge toward one another and end in an upwardly directed notch which is narrower that the diameter of a pellet.

As a result of such a design, a device of this type has been created which is simple to use and will ensure that the dosage will be dispensed without interference. It will be separated extremely gently from the remaining quantity. It is impossible for the pellets to become jammed or broken. Construction is simple and practical. This has been achieved as follows: the initial part of the cover nearest to the storage area forms an auxiliary dosing chamber, the depth of which is approximately equal to the diameter of a pellet. Its upper flanks converge with one another, and terminate in a notch which tapers upwards. Beacause of the bulkhead separation, only a few pellets flow into the auxiliary dosing chamber, and any surplus pellets are then expelled in good time, gently and undamaged, before the tapering notch disappears below the crest, i.e. the upper edge of the partition wall. To all intents and purposes, the pellets roll out over the flanks of the tapering notch and to all intents and purposes therefore sit there in the form of a point. They are separated out in a particular direction, i.e. in the opposite direction to that in which the pellets entered. Thereby, it proves advantageous that the width of the tapering notch is smaller than the diameter of the pellets. In order to optimize the gentle separation of the dosage from the remaining quantity, the invention suggests that the upper edge of the partition wall be inclined inwards, i.e. towards the storage chamber. The alignment represents a kind of "counter", which deflects the pellets over the back of the knife edge in the direction of the storage chamber. The pellets drop, to all intents and purposes, over the back of the knife edge. It is also helpful to the solution of the problem that there is a kink in the middle section of the cover. The entrance to the dosing chamber is extremely large but, as a result of the kink, there is, at the same time, a slight enlargement on the exit side, whereby the cover and floor of the dosing chamber converge in the dispensing direction. It is also an advantage if the cover is transversely grooved.

The related curvature results not only in the stabilization of the cover of the dosing chamber, which is in fact quite thin, but also proves advantageous in view of the tendency of the pellets to pile up. It is furthermore advantageous that the upper edge of the partition wall and the adjacent part of the upper side of the floor of the chamber are concave, transverse to the housing. This results in a trough-shaped, steeply inclined floor structure, which favors the flow into the dosing chamber, which is more or less in the form of a goitre. Another variation is available, favoring the release of the contents without any leftovers, in that the upper edge of the partition wall and the adjacent part of the upper side of the floor of the chamber are inclined transversely to the housing. The result is a kind of cornet as the collection point. the corresponding inclination of the partition wall also has the effect that separation does not take place along the entire length of the partition wall, but rather in a scissor-like movement.

Figure 1:
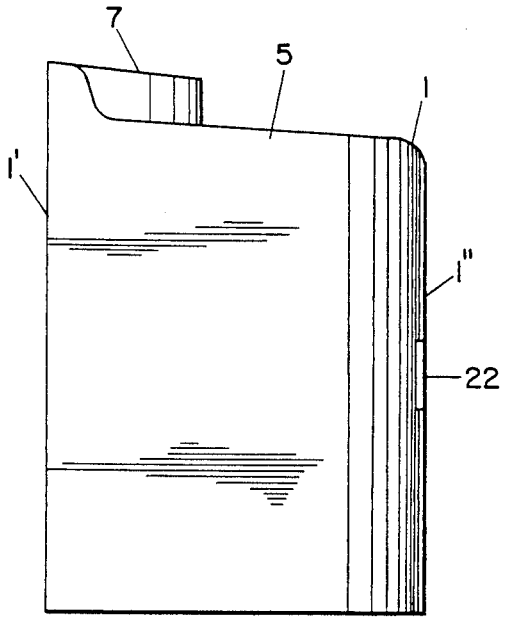

The subject of the patent will now be explained in more detail, based on two examples of applications, illustrated by means of the following diagrams:

FIG. 1 Device for dispensing portions of grainy media, in particular pellets, seen from the side, in accordance with the first application.

FIG. 2 Top view thereof.

Figure 3:
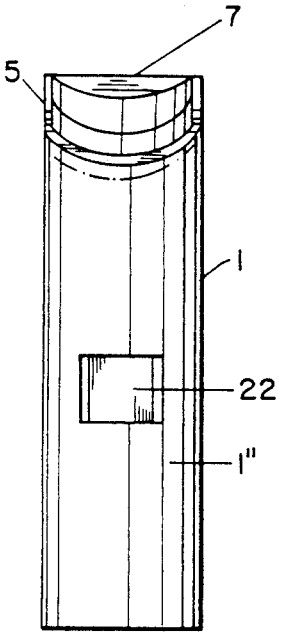

FIG. 3 Side view from the right.

Figure 4:
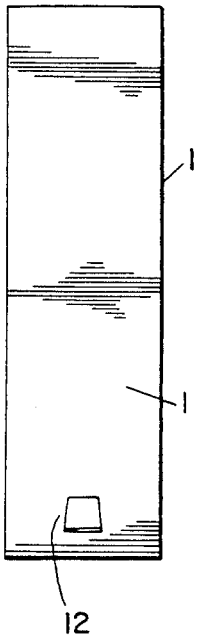

FIG. 4 Side view from the left.

Figure 5:
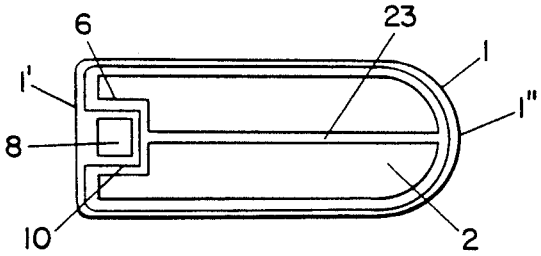

FIG. 5 The device viewed from below.

Figure 6:
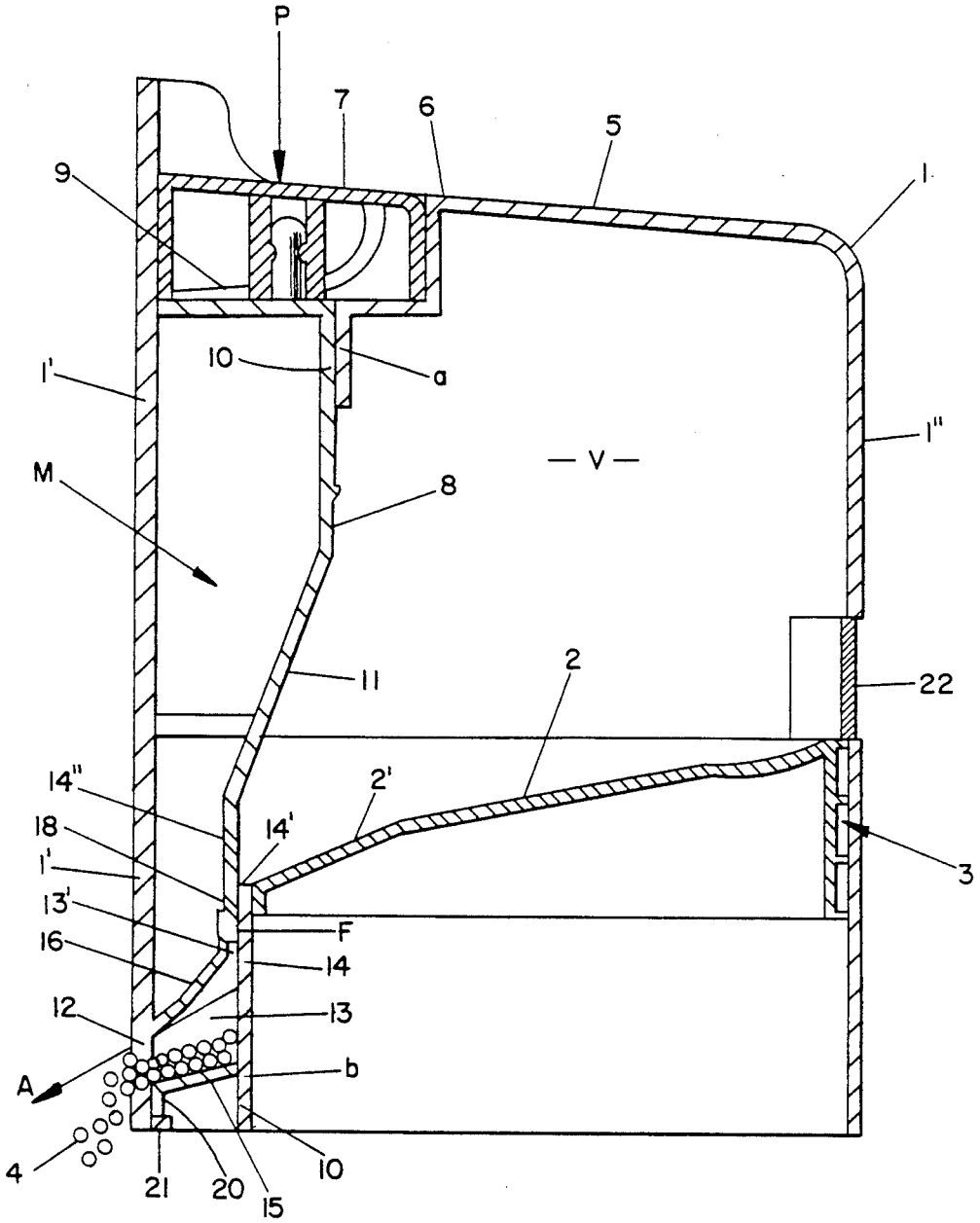

FIG. 6 Cross-section along the line VI—VI in FIG. 2, in the dispensing mode.

Figure 7:
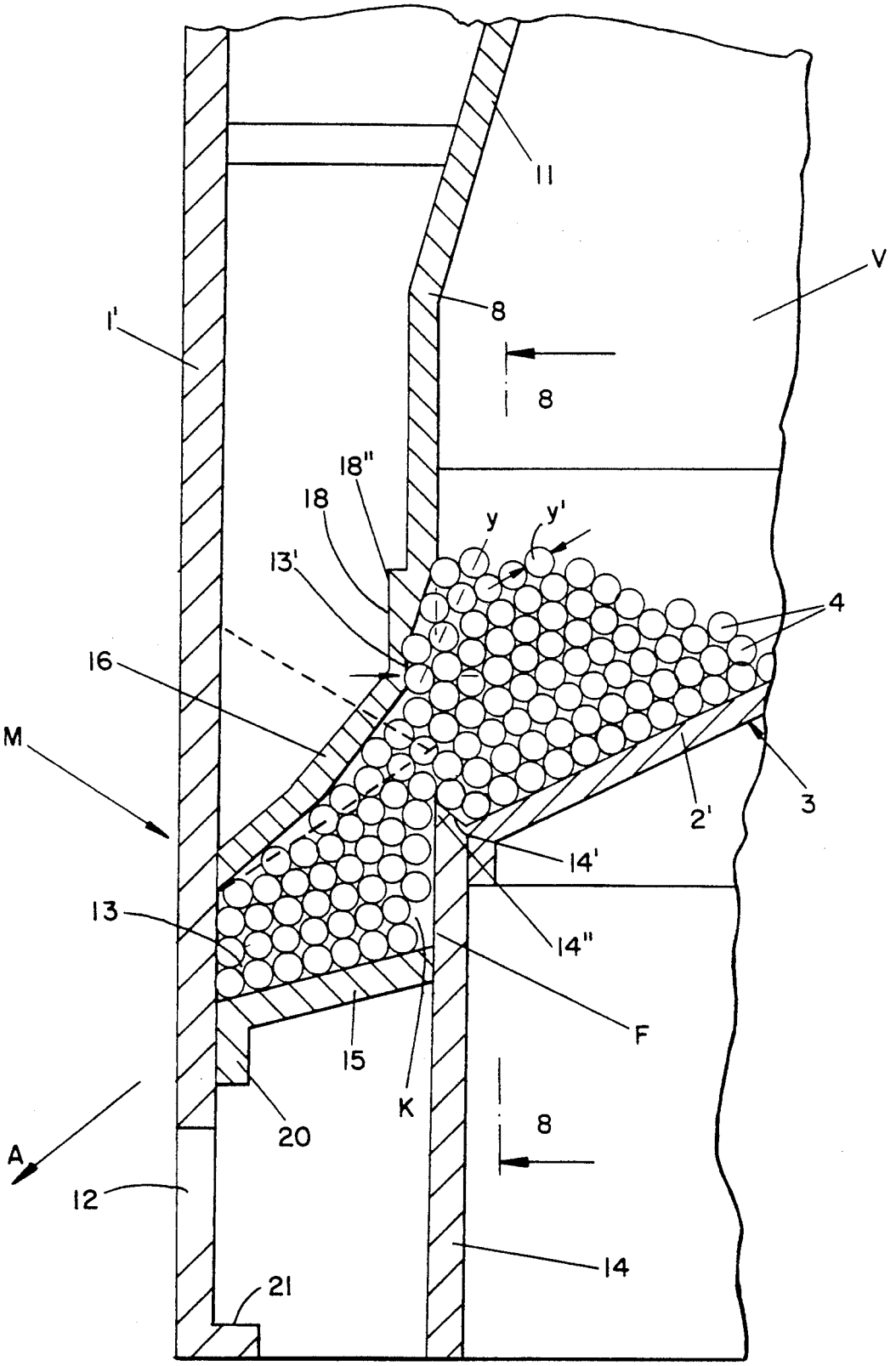

FIG. 7 An enlargement showing the area around the dosing chamber, in cross-section, along the line VII—VII in FIG. 6.

Figure 8:
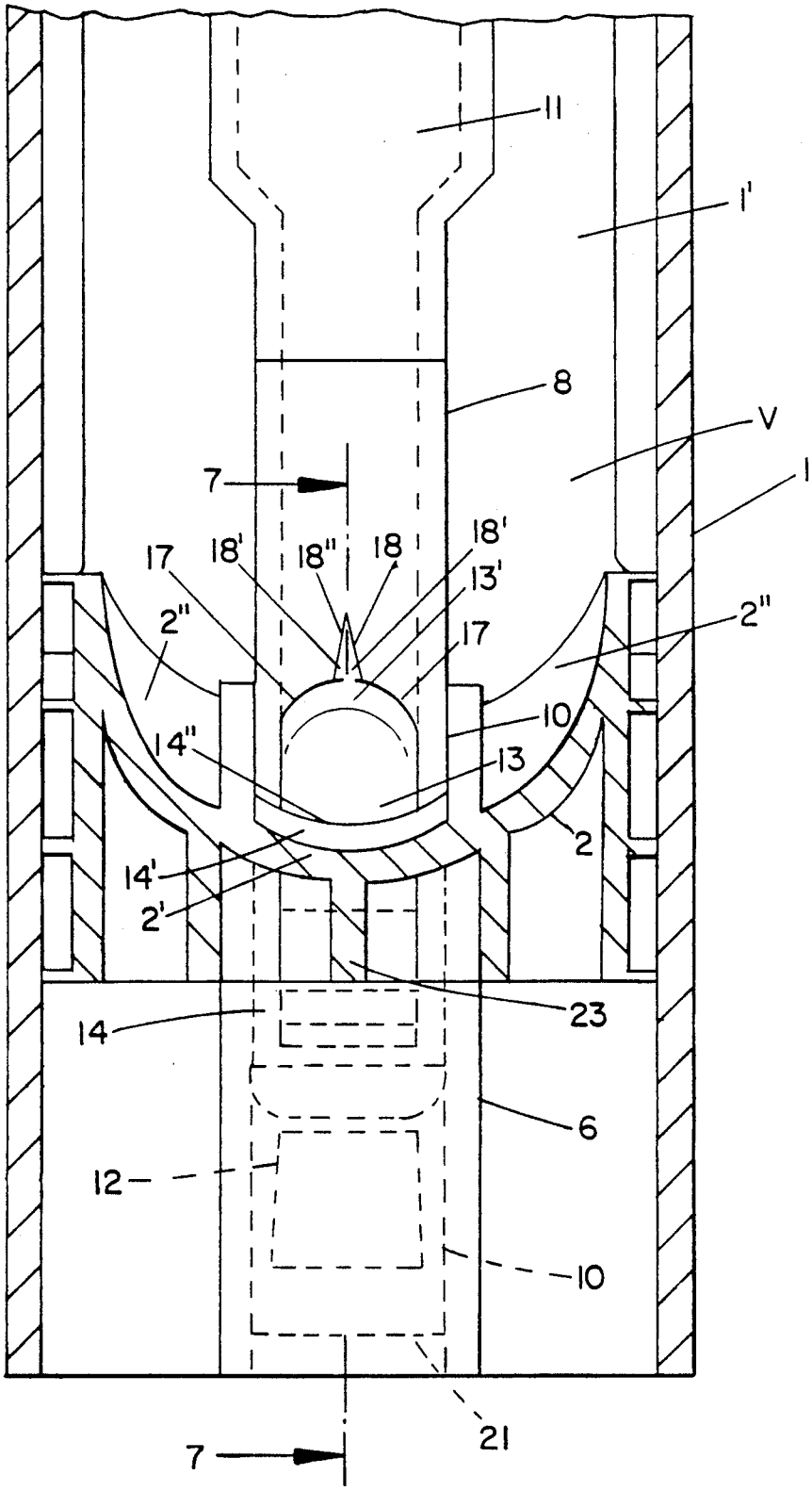

FIG. 8 Cross-section along the line VIII—VIII in FIG. 7.

Figure 9:
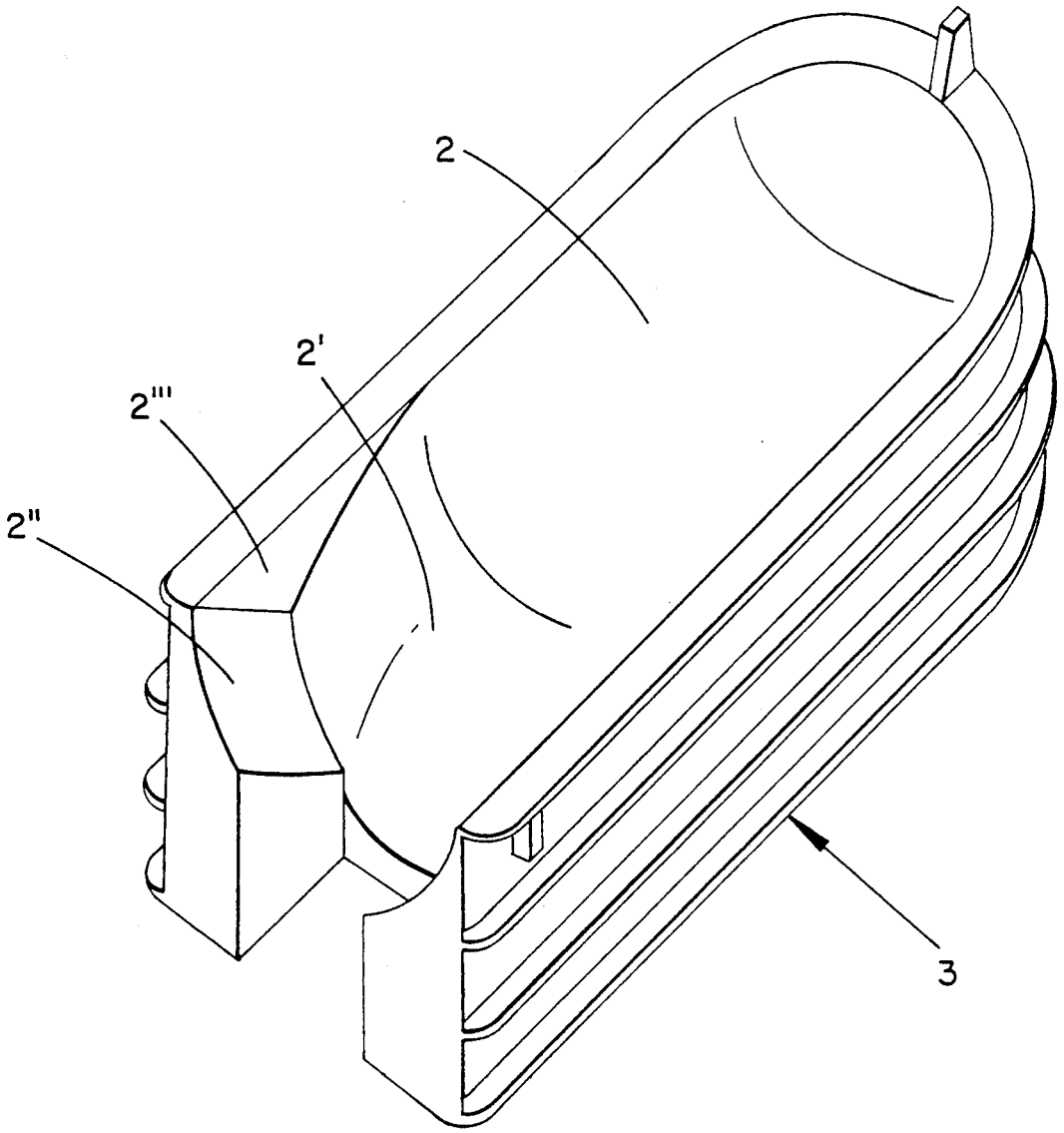

FIG. 9 The floor of the housing in the form of a tray, in perspective.

Figure 10:
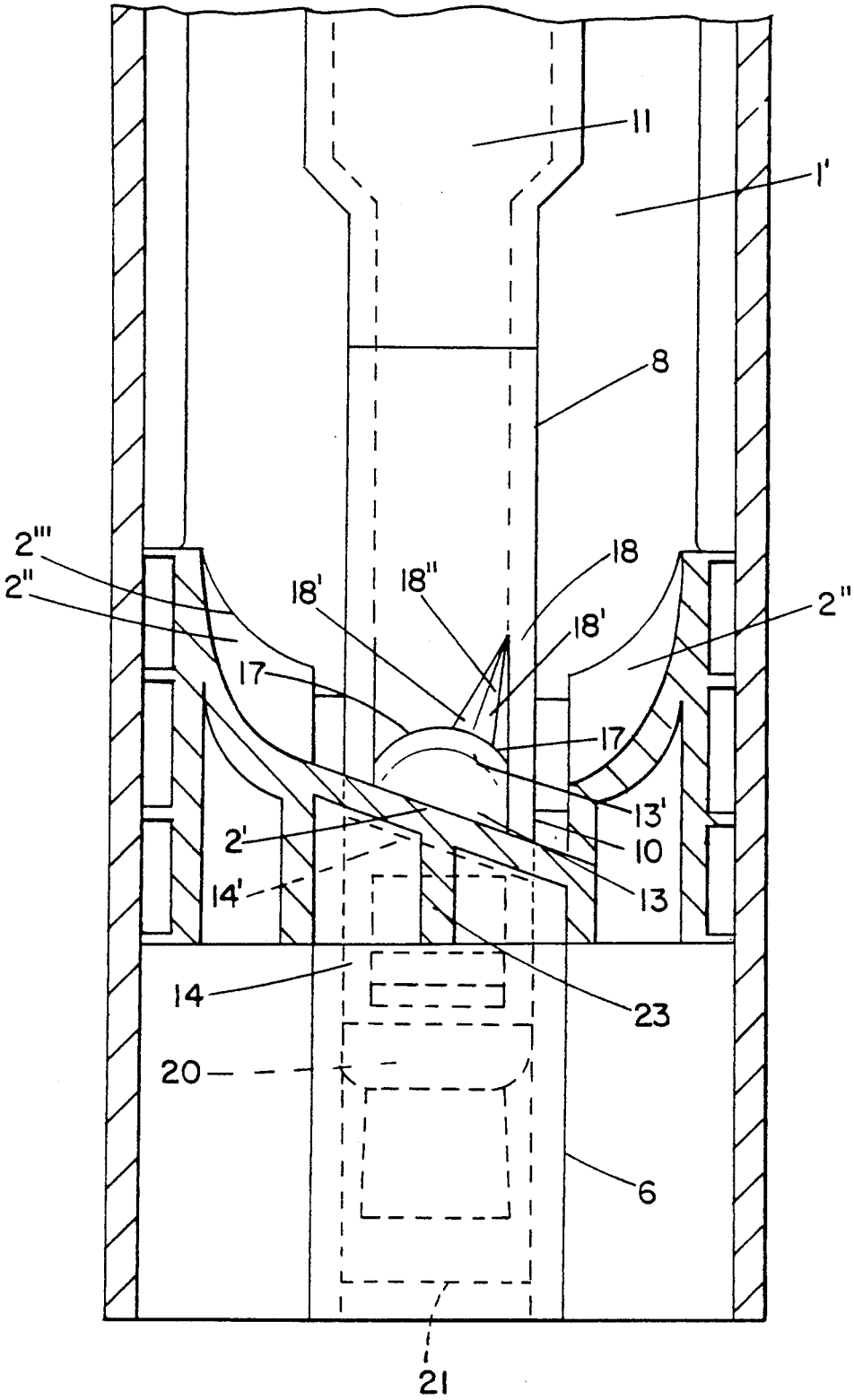

FIG. 10 The device in accordance with the second application, in cross-section, as in FIG. 8.

The device in the form of a so-called dispenser for measured dispensing of fine grainy or pearl-like material (so-called pellets) has a housing 1 of extruded plastic. The latter is relatively flat. The outlines of its basically long, square cross-section can be clearly seen from FIG. 5. The housing 1 includes a storage chamber V. This is filled from the open floor profile and then closed by means of a tray 3 forming the trough-shaped floor of the housing 2. Its outline can be seen particularly clearly in FIG. 9. The contents in the form of pearls or pellets are marked as 4. They are approximately 1 mm in diameter.

The cover of the storage chambe V is closed, apart from an aperture for the operation of the dispenser mechanisum M. This is already taken into account in the moulding.

There is therefore a tapered recess 6 in one end of the cover 5. The former contains an operating lever 7 similar to a push-button. This can be pressed vertically against a spring. It engages the actuator 8 of the dispenser mechanism M, which is guided in the housing 1.

The return mechanism for the actuator 8 is formed by a laminated spring 9, which is already attached to the operating lever 7. The spring abuts on the floor of the recess 6. The laminated spring 9 is arched. The floor of the recess takes into account the necessary displacement space when it is moved during operation (see FIG. 6).

The actuator 8, which is U-shaped in cross-section, but closed at the top, is guided by a vertical shaft 10, cut into the middle section, which is open in the direction of the storage chamber V. The upper section of the shaft a is an inward-facing collar on the recess 6, corresponding to the shape of the actuator (none-transverse). The sections of the inner wall of the collar are rooted in the narrow wall 1' on the left-hand side of the housing 1. This narrow wall thus forms part of the shaft.

The upper part a of the shaft is wider than the lower section b, and is nearly twice as broad as the lower part. The lower section of the actuator is also correspondingly narrower. The transitory zone between the two parts a and b of the shaft is formed by a transitional tapered shoulder 11.

This overhang, which can be clearly seen in FIG. 6, gives a certain amount of help in pushing the pellets 4 in the direction of the floor when the actuator 8 is moved downwards. In addition to gravitational force, this assistnce can even further the task by loosening the pellets 4 to some extent, which is useful if they are sticking together as a result of moisture.

The upper section a and lower section b of the shaft are at a distance from the broadside wall of the housing 1, as can be seen from FIG. 8 and FIG. 10. There is a opening 12 for dispensing the dosage in the direction of the arrow A, in the form of a window in the flat narrow wall 1' on the left-hand side of the housing 1. Its sill is slightly inclined in the dispensing direction.

The related dispensing is controlled by the actuator 8, which has a dosing chamber 13, which can be lowered to a position congruent to the dispensing aperture, which is located further down. The exit on the dispensing side of the dosing chamber 13 has exactly the same dimensions as the window. The entrance on the same side as the storage chamber has teh same width, but is higher. Part of the cross-section of this entrance in FIG. 7 is, however, obscured by part of the lower section b of the shaft, which is labelled as the partition wall 14. This partition wall 14 runs parallel to the narrow wall 1' of the housing. Its upper edge 14' terminates virtually at the same level as the adjacent part 2' of the upper surface of the floor of the housing 2. The corresponding part 2' once again slopes in relation to the rest at an angle in the direction of the dosing chamber 13. The floor 15 and the cover of the dosing chamber 13, whose volume is much greater than that of the diameter of a pellet 4, similarly slopes in the dispensing direction (arrow A). The slopes forming the floor are at an angle which favors the rolling down of the pellets. As can be seen from FIG. 7, the floor 15 of the dosing chamber 13 is at a lower level than the upper edge 14' of the partition wall 14. As a result of this, a goitre K is created to all intents and purposes in relation to the dosage, which has been partitioned off in respect of the dosing chamber, and which will always be refilled by gravity in the basic position.

Special arrangements have been made, aimed at the gentle, i.e. undisturbed separation of the dosage from the remaining quantity in the storage chamber V. These are that the first part of the cover 16 on the same side as the storage chamber, which is significantly steeper than the floor 15 of the dosing chamber, forms an auxiliary dosing chamber 13'.

The depth y of the latter, perpendicular to the vertical direction of thrust of the actuator 8, is approximately or at least the diameter y' of a pellet 4. The auxiliary dosing chamber 13' tapers upwards from the maximum width of the dosing chamber, i.e. towards the operating lever 7 (see FIG. 8). The related flanks 17 taper in the direction of the symetrical axis (corresponding to the cross-section VII—VII). Preferably, this should be in the form of a semi-circular arc. Another kind of tapering, converging in the tip or the apex, such as flat curve phases, can naturally also be employed. There is a notch 18, starting at the highest point of the auxiliary dosing chamber 13'. The initial depth of the notch is the same as the depth y of the auxiliary dosing chamber 13'. The base of the notch runs upwards at an angle of some 30°. The flanks 18' become correspondingly more tapered. The V-angle of the notch is some 40°, but can be greater than this. The initial width of the notch 18 (the transitional area between the dosing antechamber 13' and the notch 18) is less than the diameter y' of a pellet. The transitions are rounded in each case.

As a result of these measures, thos pellets for which there is no room in the dosing chamber are gently diverted out as the actuator 8 is moved downwards. The upper edge 14' of the partition wall 14, which is inclined in the direction of the storage chamber V has a corresponding effect thereby. The base 18'' of the notch and the upper edge 14' of the partition wall 18, which are inclined towards the back, diverge in the direction of the storage chamber (see FIG. 7). The bevel of the partition wall 18 on the side towards the dosing chamber, which stands at a sharp angle in the notch area, is acting to all intents and purposes as a dividing finger in the notch area. It is also sufficient if the peak of a corresponding transverse curvature is at a distance from the joint F which is less than the radius of a pellet.

The angle of inclination of the upper edge favors the rolling of a pellet. Floor 2 and section 2' of the tray 3 in the first application are transversely troughed over the entire length. The result is a collection groove in the middle plane of the dispenser. As can be seen from FIG. 8, the upper edge 14' is curved in the transverse direction. For reasons of clarity, the floor 2 of the housing is shown in cut-out somewhat lower down.

In the second application example (see FIG. 10), the concave transverse trough form of the floor 2 of the housing has been abandonned in favor of the alignment of the neighboring part 2' of the upper side of the floor 2 of the housing, which slopes downwards in a transverse direction. This is inclined towards the right, taking into account the process of separation. As a result of this, the separation of the pellets from the remaining quantity does not take place over the entire length, but is in the form of a scissor movement. The measure described in FIG. 7 and FIG. 8 is also, in this case, responsible for the final diversion of those pellets y, which have not fallen down into the dosing chamber 13. The notch 18 can naturally once again be in the axis of symmetry, or, as shown as an alternative in FIG. 10, perpendicular to the upper edge 14' of the partition wall, which is sloping down towards the right, or perpendicular to the upper side of the floor 2 of the housing, which is correspondingly inclined. The remaining pellets will collect there at the lowest point. In order to ensure that the pellets are dispensed without any leftovers, the deepest section can once again start to climb in the opposite direction (this is not shown). Otherwise, the reference numbers are applied analogously. As far as the lateral projections from the floor 2 of the housing encompassing the shaft 10 are concerned, inclinations 2'', 2''' are used, which help to centralize the pellets in the direction of dispension A (see FIG. 9).

The base of the recess 6, onto the upper side of which the lower edge of the cowl-shaped operating lever 7 impacts, acts as an arresting device. In addition, the body of the cowl is attached to the upper, enclosed zone of the actuator 8, but can form a single continuous piece with this, if another kind of spring chamber is available.

Independently of this or in addition, movement can be arrested by extending the floor 15 of the dosing chamber 13 by a finger 20 pointing downwards and pressing against the inner surface of the narrow wall 1', whose tip comes up against a shoulder 21 on the above-mentioned wall.

The narrow wall 1'' opposite to the narrow wall 1' is curved convexly. The part referred to contains an inspection window, which can be clicked home, so that the quantity can be controlled optically.

In order to refill the device, all that has to be done is to pull down the tray 3 forming the floor 2 of the housing. This can be achieved by grasping a stay 23 in the midle section of the dispenser, which is already attached to the tray 3.

After refilling, the tray can be easily pushed back in until it clicks into place. It is held firmly by horizonal ribs around the peripheral edge.

Looking in the direction of the arrow A, the cover 16 of the dosing chamber 13 is transposed at an oblique angle, so that the exit is larger. The corresponding kink is in the middle section.

Briefly, the dispenser functions as follows:

The actuator 8 is displaced downwards by exerting force in the direction of the arrow P (see FIG. 6). The pellets 4 in the dosing chamber fall further and further below the silhouette of the upper edge 14' of the partition wall 14. Any pellets on the upper edge 14' fall off in the direction of the storage area. Pellets for which there is no further room in the dosing chamber, which continues to move downwards, are accumulated by a wedge-shaped area, which becomes gradually narrower, into the auxiliary dosing chamber 13'. Only a few pellets are to be found here, but they are included in the quantity dispensed. In the final phase of the downward movement of the actuator 8 or rather the dosing chamber 13, the surplus pellets in the upper part of the dosing antechamber run into the notch 18, from which they are then gently directed towards the remaining storage area V. Following the corresponding separation from the remaining quantity, the further sinking of the actuator 8 causes the exit to the dosing chamber 13 facing towards the dispensing opening 12 to come into corresponding alignment with the dispensing opening 12. The allocated quantity rolls out in the direction of the arrow A. When the operating lever is released, the spring causes the actuator to snap back into the starting position.

We claim:

1. In a device for the dosed dispensing of grainy media, in particular pellets, from a housing, the housing defining a storage space for storing the grain media, the housing further having a bottom and a dispensing opening adjacent the housing bottom, the device including a hand-operated actuator, the actuator being movable in a dispensing direction relative to the dispensing opening between a first position for closing the dispensing opening and a second dispensing position, the actuator defining a dosing chamber having a first end portion which is closed in the dispensing position of the actuator relative to the storage space by a partition wall, the dosing chamber having a second end portion which is in the dispensing position of the actuator in communication with the dispensing opening, the dosing chamber further being defined by a cover which is inclined in the dispensing direction, the dosing chamber having a size which substantially greater than the diameter of a pellet, the improvement comprising a portion of the cover adjacent the storage space defining an auxiliary dosing chamber, the auxiliary dosing chamber having a depth which corresponds approximately to the diameter of a pellet, the portion of the cover defining the auxiliary dosing chamber having upper flanks which converge toward one another and end in an upwardly directed notch, wherein the notch is narrower than the diameter of a pellet.

2. Device in accordance with claim 1, wherein the partition wall (14) has an upper edge (14') that inclines downwardly towards the storage chamber.

3. Device in accordance with claim 1, wherein the cover has a middle portion, a kink being formed in the middle of the cover (16).

4. Device in accordance with claim l, wherein the dosing chamber has a floor, and wherein the cover (16) and the floor (15) of the dosing chamber (13) converge in the dispensing direction.

5. Device in accordance with claim 1, wherein the cover (16) is curved in the transverse direction thereof.

6. Device in accordance with claim 1, wherein the partition wall has an upper edge (14') and the bottom of the housing has a part neightboring the upper edge, and wherein the upper edge (14') of the compartment wall (14) and the neighboring part (2') of the bottom (2) of the housing are concave and transverse to the housing (1).

7. Device in accordance with claim l, wherein the partition wall has an upper edge (14') and the bottom of the housing has a part neighboring the upper edge, and wherein the upper edge (14') of the compartment wall (14) and the neighboring part (2') of the bottom (2) of the housing decline and are transverse to the housing (1).

* * * * *